US007572207B2

(12) United States Patent
Postma

(10) Patent No.: US 7,572,207 B2
(45) Date of Patent: Aug. 11, 2009

(54) CLIMBING WALL STRUCTURE AND METHOD OF CONSTRUCTION

(75) Inventor: Nathan B. Postma, White Bear Lake, MN (US)

(73) Assignee: Nicros, Inc., St. Paul, MN (US)

( * ) Notice: Subject to any disclaimer, the term of this patent is extended or adjusted under 35 U.S.C. 154(b) by 432 days.

(21) Appl. No.: 11/125,977

(22) Filed: May 10, 2005

(65) Prior Publication Data

US 2006/0258511 A1 Nov. 16, 2006

(51) Int. Cl.
*A63B 9/00* (2006.01)

(52) U.S. Cl. ..... 482/37; 482/35

(58) Field of Classification Search ..... 482/35–37
See application file for complete search history.

(56) References Cited

U.S. PATENT DOCUMENTS

| | | | | |
|---|---|---|---|---|
| 5,125,877 | A | 6/1992 | Brewer | |
| 5,242,652 | A | 9/1993 | Savigny | |
| 5,254,058 | A * | 10/1993 | Savigny | 482/37 |
| 5,549,195 | A | 8/1996 | Aulagner | |
| 5,944,634 | A | 8/1999 | Neves | |
| 6,074,327 | A | 6/2000 | Franklin | |
| 6,390,952 | B1 * | 5/2002 | Wilson | 482/37 |
| 6,402,663 | B1 | 6/2002 | Popp | |
| 6,514,178 | B2 * | 2/2003 | Vettori | 482/37 |
| 6,540,645 | B1 | 4/2003 | Zeilinger | |
| 6,544,145 | B2 * | 4/2003 | Yoshida et al. | 482/35 |
| 6,551,215 | B1 | 4/2003 | Gordon | |
| 6,629,907 | B2 | 10/2003 | Popp | |
| 6,699,158 | B1 * | 3/2004 | Richardson et al. | 482/37 |
| 6,709,365 | B2 | 3/2004 | Zeilinger | |
| 2002/0019297 | A1 | 2/2002 | Vettori | |
| 2002/0022552 | A1 | 2/2002 | Yoshida et al. | |
| 2002/0098949 | A1 | 7/2002 | Popp | |
| 2002/0169052 | A1 | 11/2002 | Godsey | |
| 2003/0013579 | A1 | 1/2003 | Rennex | |
| 2003/0060333 | A1 | 3/2003 | Sudeith | |
| 2003/0153432 | A1 | 8/2003 | Zeilinger | |
| 2003/0228956 | A1 * | 12/2003 | Paci | 482/37 |

* cited by examiner

*Primary Examiner*—Fenn C Mathew
(74) *Attorney, Agent, or Firm*—Moore & Hansen, PLLP

(57) ABSTRACT

A climbing wall structure comprising of a primary frame and a plurality of wall panels is described. Each wall panel has a periphery adapted for abutment with an adjacent wall panel. Each wall panel is connected to adjacent panels with a mounting bracket, such that the wall panels form an integral exterior surface adapted for climbing. The primary frame and the wall panels are connected with kicker struts. Each kicker strut has a first end and a second end. The first end is mounted to a non-peripheral region of the wall panel. This differs from the prior art walls which connect kicker struts to angle iron or tube steel surrounding the periphery of a wall panel. Prior art walls are thus heavier, use more material, and not easily disassembled. In the present invention webbing is also used for positioning. A method for installing an artificial climbing wall structure is also described.

18 Claims, 5 Drawing Sheets

CLIMBING WALL STRUCTURE AND METHOD OF CONSTRUCTION

FIELD OF THE INVENTION

The present invention is directed to climbing walls. More specifically, the present invention is directed to a wall structure that is light weight and easier to install.

BACKGROUND OF THE INVENTION

The sport of rock climbing is becoming more popular as a means of recreation. In order to develop the necessary skills to participate in this sport, many individuals practice on a simulation device that typically includes a climbing wall containing a plurality of man made climbing holds fastened thereto. Climbing of these man made walls has also become a sport of its own, with walls being designed to accommodate the various skill levels of climbers. In the United States, climbers use a standard rating system to describe the difficulty of different routes. There are six classes in this system, ranging from class one (normal walking) through hiking, scrambling and then climbing at class five. Generally "rock climbing" falls in class five. Class six climbing is climbing on rock walls that are so smooth there is no way to climb them without artificial aids (i.e. special climbing ladders or equipment). Class five climbing is climbing without using the equipment to ascend, but instead utilizing the equipment for protection from a fall. Within class five there are currently fifteen different levels that break down in the following manner: 5.0 through 5.4—beginner level which is easy to climb, like a ladder. 5.5 through 5.7—intermediate level which is climbable in normal shoes or boots but requiring more skill. 5.8 through 5.10—experienced level, which generally requires climbing shoes, experience and strength. 5.11 through 5.12—expert level that perhaps only the top 10% of climbers in the world can climb these routes. 5.13 and up is the elite level which can only be climbed by the best of the best.

The basic premise behind rock climbing is extremely simple. The climber is trying to climb from the bottom to the top of a rock wall or artificial climbing wall. If that was all there were to it, then the climber would need nothing but his or her body and a good pair of climbing shoes. However, safety issues arise in the sport if the climber slips anywhere along the way. Because of the possibility of falling, rock climbing involves a great deal of highly specialized equipment to catch climbers when they fall.

Part of the specialized equipment used on artificial rock walls includes climbing holds. Climbing holds often referred to as handholds, are grabbed and stepped on by a climber in order to ascend the wall. It is important for the holds to be rigidly secured to the climbing wall in order to prevent the hold from moving under the weight of a climber. Also, climbing holds come in a variety of configurations in order to simulate movement patterns in climbing. Such holds are typically formed of synthetic material such as a polyester resin or polyurethane, but may also be natural materials such as wood or rock.

There are two conventional types of climbing walls that are used to simulate rock climbing activity. The first type of climbing wall includes a substantially vertical climbing surface that has a rock like texture (See e.g. U.S. Pat. No. 5,254,058 to Savigny, "Artificial climbing wall with modular rough surface", Oct. 19, 1993). The shape, angle (degree of overhang), or texture of the climbing wall determines the level of difficulty associated with maneuvering over this type of climbing wall. The second type of climbing wall includes rock-like hand and foot holds that are attached to a normal (i.e., substantially smooth) wall (See e.g. U.S. Pat. No. 5,125,877 to Brewer, "Simulated climbing wall," Jun. 30, 1992). There are two ways to adjust the level of difficulty associated with maneuvering about this type of climbing wall. First, the location of the holds on the wall vary according the level of skill of a particular climber. Second, the shape of the individual holds can be modified in order to make them easier or more difficult to grasp.

Using artificial climbing walls to simulate outdoor rock climbing activity is well known. Artificial climbing walls provide rock-climbing enthusiasts with the opportunity to simulate outdoor rock climbing activity at an easily accessible location. The climbing holds are normally attached to a wall using bolts or threaded fasteners. The climbing holds are typically of varying shapes and textures that affect the level of skill required to maneuver on the climbing wall. In particular, climbing walls that have a minimal number of holds are harder to climb or ascend and make it harder to reach the top of the wall. Another factor affecting the level of skill required to maneuver on the climbing wall is the position of the climbing holds on the climbing wall. The closer the climbing holds are positioned relative to one another, the more climbing holds there are available for grasping by a climber as the climber maneuvers on the climbing wall.

There are many factors that affect the price of an artificial climbing wall, including the size of the wall, the type of wall, geographical location, and site and accessibility issues. Materials for the artificial climbing wall, steel framework, engineering, installation, equipment rental, handholds and top anchors also affect the cost of artificial climbing walls. Furthermore, climbing equipment such as ropes, harnesses, belay devices, landing surfaces and training are aspects the artificial climbing wall installer or purchaser must think about as well.

Three factors that impact how large an artificial climbing wall can be are the budget available, the size of space available, and the number of climbers to accommodate. For example, assume there are 6 linear feet of climbing wall per route or climbing line. Therefore, if there are 5 climbers to accommodate, there will be 30 feet linear (horizontal) feet of wall necessary. Assuming the space is 28 feet tall, multiplying the length times the height times a factor of 1.2 will give the approximate total square feet of climbing surface. Therefore, 30 feet long multiplied by 28 feet tall multiplied by 1.2 gives 1008 square feet of total climbing surface area.

It is a common misconception that the amount of space needed to build an artificial climbing wall is simply the amount of space necessary to house the wall. The space for the framing of the wall, the ability to get behind the wall for access, and the space needed in the foreground (in front of the wall) for someone to "fall" is also important. In the climbing wall industry typically a "swing radius" from each anchor point is calculated to determine how much space is needed in front of the wall for a protective landing surface. First, to calculate the swing radius, the amount of overhang for each top rope anchor (the distance the top anchor sits in front of the base of the wall) must be determined. Second, that overhang distance is multiplied by 2.25. This determines the distance a person could swing out from the wall when they fall while being tied to a top-rope.

Prior art climbing walls utilize large amounts of raw materials (i.e., steel and plywood) that can make installation slow and expensive. In particular, prior art climbing walls use angle irons around the periphery of plywood wall panels to attach them to a frame. This "perimeter framing" technique makes the wall heavy and not easy to deconstruct in the event of reconfiguration of the wall panels. The present invention overcomes this and other problems associated with the prior art.

SUMMARY OF THE INVENTION

An artificial climbing wall structure is described. The wall structure has a primary frame and a plurality of wall panels. Each wall panel has a periphery adapted for abutment with an adjacent wall panel. Additionally, each wall panel is connected to adjacent wall panels with a mounting bracket such that the wall panels form an integral exterior surface adapted for climbing. Furthermore, the primary frame and the wall panels are connected with kicker struts. Each kicker strut has opposite first and second ends. The first end has a flat bearing surface which is mounted on the wall panel, and the second end has a second flat bearing surface which is secured to the primary frame. This secures the climbing wall "skin" or surface to a substantial frame often called the primary frame. In particular, the first end is mounted to a non-peripheral region of the wall panel. This differs from the prior art artificial climbing walls, which connect kicker struts to angle irons surrounding the periphery of a wall panel. Prior art climbing walls are heavier, utilize more material, and are not easy to disassemble and require more labor to install. Additionally in the present invention, web straps removably connect the wall panels to the primary frame for positioning purposes. A method for installing an artificial climbing wall structure is also described.

Additional advantages and features of the invention will be set forth in part in the description which follows, and in part, will become apparent to those skilled in the art upon examination of the following or may be learned by practice of the invention.

DETAILED DESCRIPTION

Figure 1:
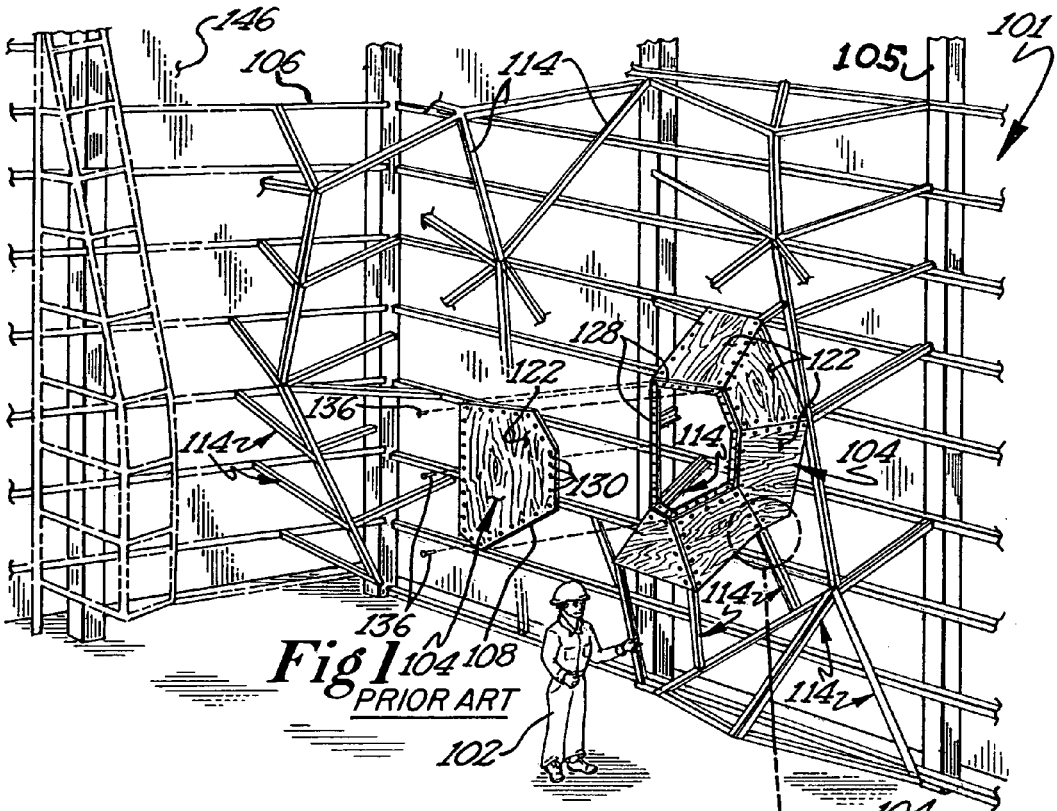
Fig 1 PRIOR ART
FIG. 1 is a perspective view of a partially constructed prior art wall structure.

FIG. 1 is a perspective view of a partially constructed prior art wall structure 101. Prior art wall structures 101 have a primary frame 106 that is used as a base for the wall. The primary frame consists of columns or tubes 105 and horizontals or girders 106 (collectively called the "primary frame") is connected to an adjacent building wall 146. Kicker struts 114 attach the girders 106 to wall panels 104 via angle irons 128. The angle irons 128 are typically mounted to a wall panel periphery 108. The kicker struts 114 are then attached to these angle irons 128 to hold the wall panels 104 in place. Prior art wall structures 101 are heavier, use a large amount of raw materials, and are slower to install because the angle irons 128 are mounted to surround the wall panel periphery 108. It will be understood by those skilled in the art that this may be called a "perimeter frame" technique because the angle irons 128 frame the perimeter of the wall panels 104.

Figure 2:
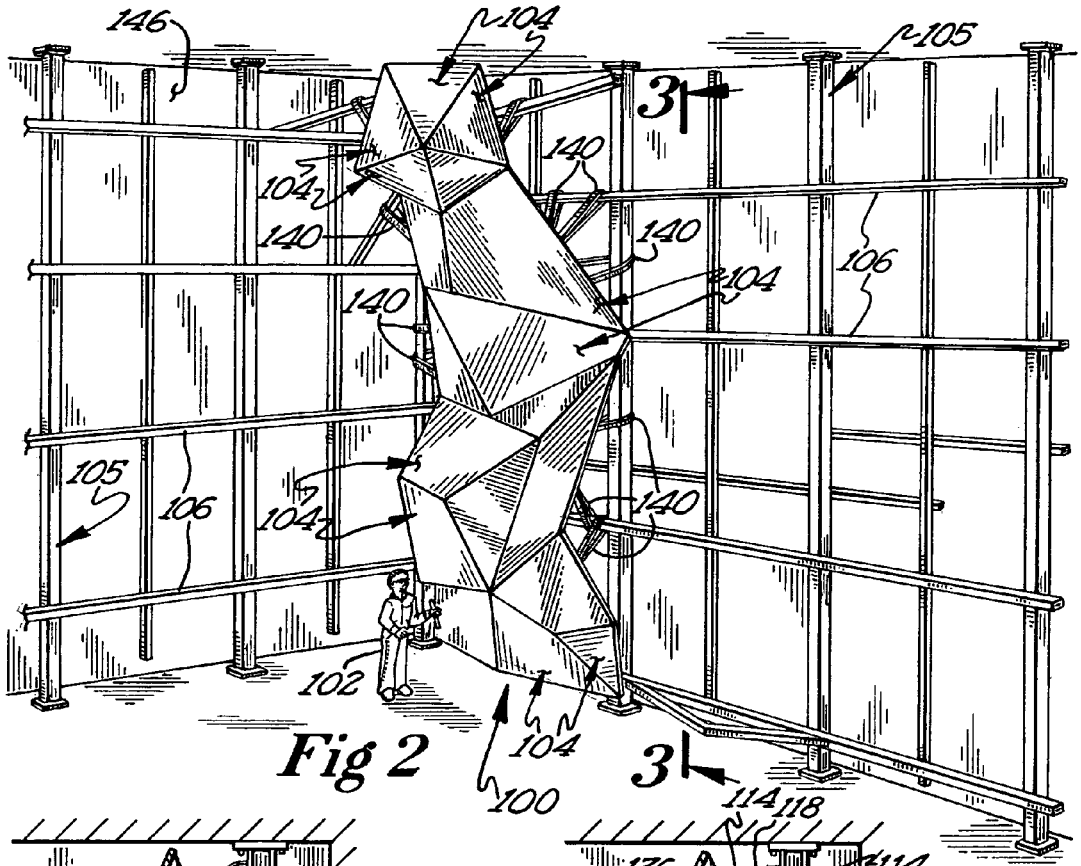
FIG. 2 is a perspective view showing a wall structure under construction according to a teaching of the present invention.
Figure 3:
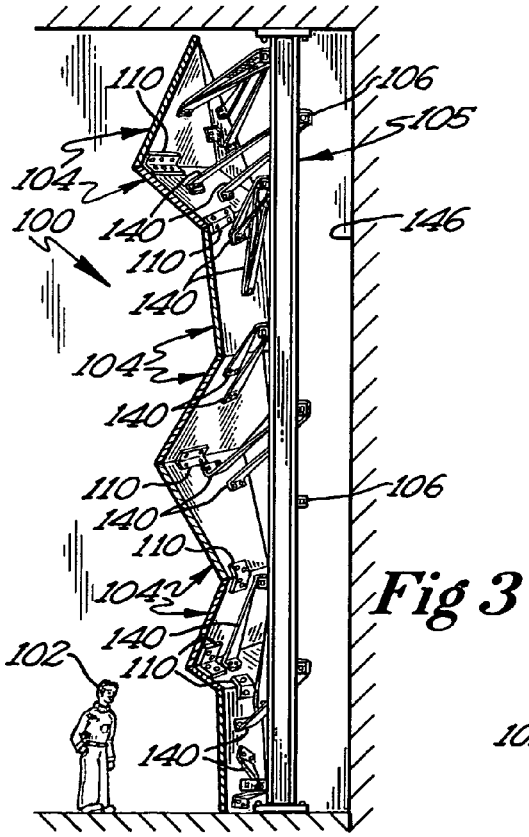
FIG. 3 is an end elevational view showing panels of the wall structure held in relative alignment by webstraps attached to the primary frame.

FIG. 2 shows a perspective view of a wall structure 100 under construction according to a teaching of the present invention. The wall structure 100 also utilizes the primary frame that consists of columns or tubes 105 and horizontals or girders 106 to connect to an adjacent building wall 146. If the building wall 146 serves as the columns 105, then the girders 106 may be attached directly to the building wall 146 to collectively form the "primary frame". It will be appreciated by those skilled in the art that the primary frame 106 is constructed from, but not limited to, bars of steel. In preferred embodiments, web straps 140 are attached to the primary frame 106. The web straps 140 are then mounted to wall panels 104. The web straps 140 help position the wall panels 104 in a desired configuration to the primary frame 106. It will be appreciated by those skilled in the art that web straps 140 may be attached to the wall panels 104 with bolts or screws. FIG. 3 is an end elevational view showing wall panels 104 held in relative alignments by web straps 140 attached to the primary frame 106.

Figure 3A:
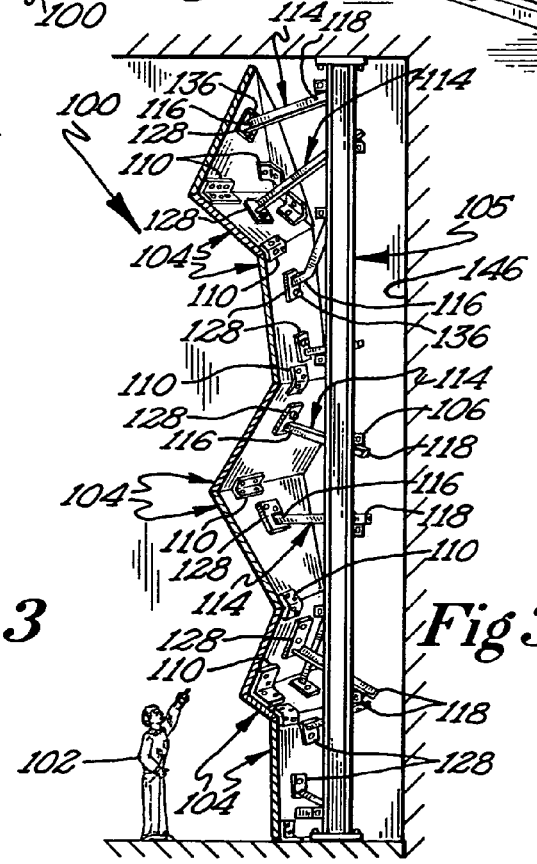
FIG. 3*a* is an end elevational view of FIG. 3 with the wall panels hard mounted to the primary frame with kicker struts.

FIG. 3*a* is an end elevational view of FIG. 3 with the wall panels 104 hard mounted to the primary frame 106 with kicker struts 114. After the web straps 140 are mounted to the wall panels 104, kicker struts 114 are attached to angle irons 128 in a middle area of the wall panels 104. Having the kicker struts 114 mounted in this manner utilizes less steel and is easier to install than the "perimeter-frame" technique of the prior art wall structure 101. Once the kicker struts 114 are attached to the wall panels 104, the web straps 140 from FIG. 3 are removed.

Figure 4:
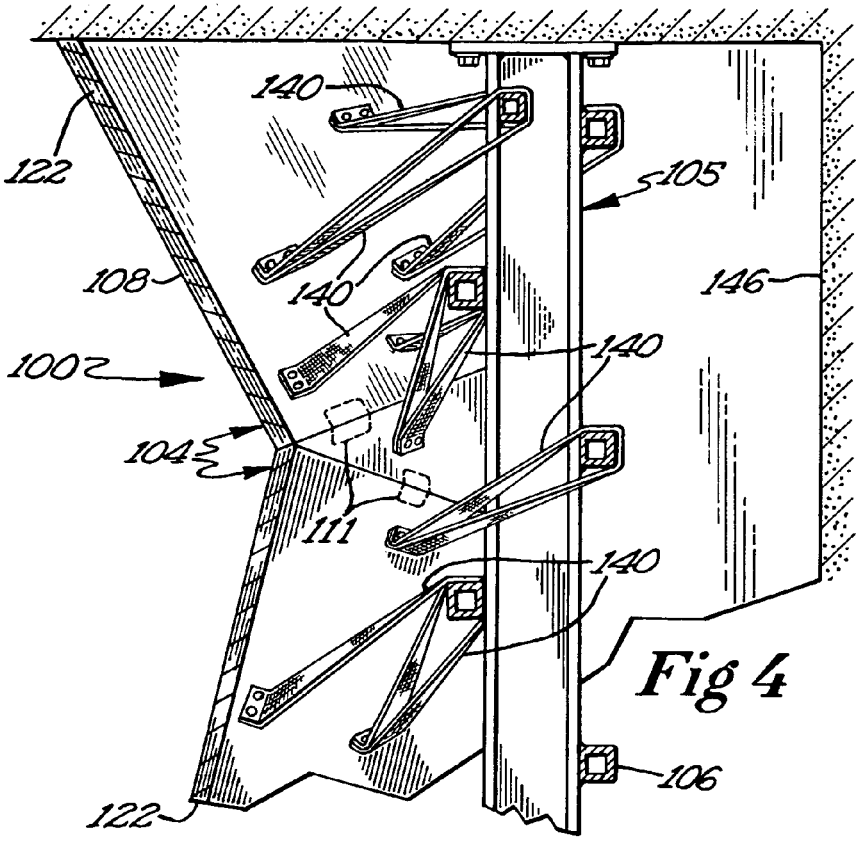
FIG. 4 is an enlarged portion of FIG. 3 showing the details of the web strap mounting.

FIG. 4 is an enlarged portion of FIG. 3 showing the details of the web strap mounting. Phantom mounting bracket positions 111 are shown. Phantom mounting bracket positions 111 are optional places where actual mounting brackets 110 are installed between wall panels 104. The mounting brackets are shown in FIG. 4*a*.

Figure 4A:
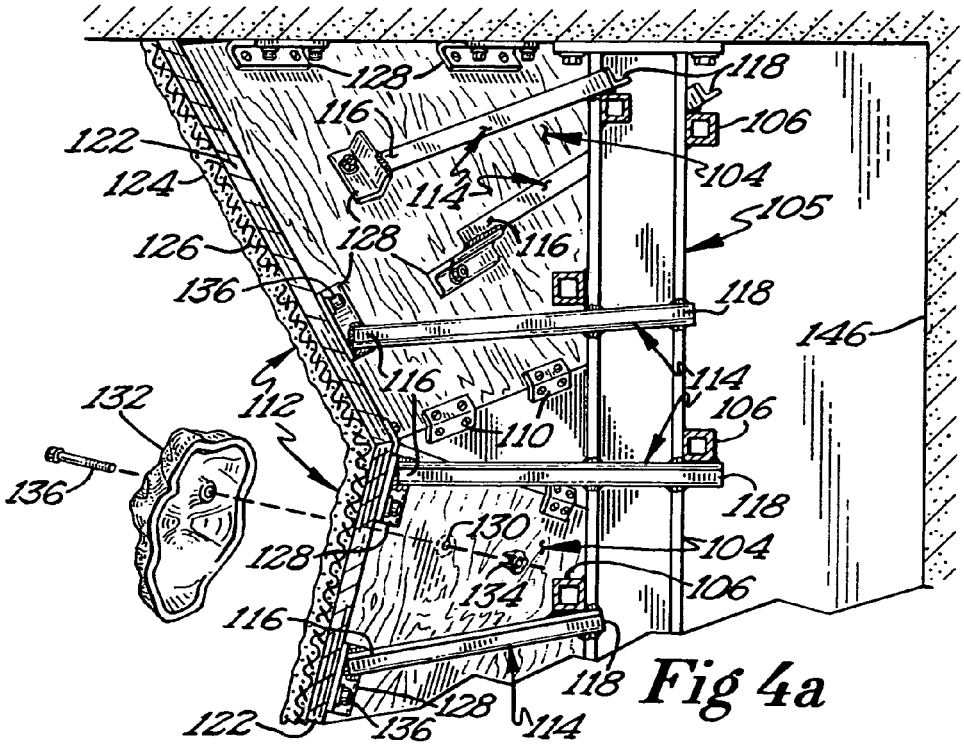
FIG. 4*a* is an enlarged portion of FIG. 4 with an exploded view of a handhold device.

FIG. 4*a* is an enlarged portion of FIG. 4 with an exploded view of a handhold device 132. Mounting brackets 110 are installed between wall panels 104 for added strength and support to the wall structure 100 replacing the perimeter frame. Installing the mounting brackets 110 between wall panels 104 also helps in forming an integral exterior surface 112. Furthermore in alternative embodiments the wall structure 100 may have wall panels 104 formed in an irregular shape to resemble a natural rock surface. Also the wall panels 104 may have a surface adapted for gripping by a climber. In FIG. 4*a* the web straps 140 have been removed and instead kicker-struts 114 are mounted to angle irons 128. The first ends 116 of the kicker struts 114 are attached to a center region of the wall panels 104. The second ends 118 of the kicker struts 114 are attached to the primary frame or girders 106.

Figure 5:
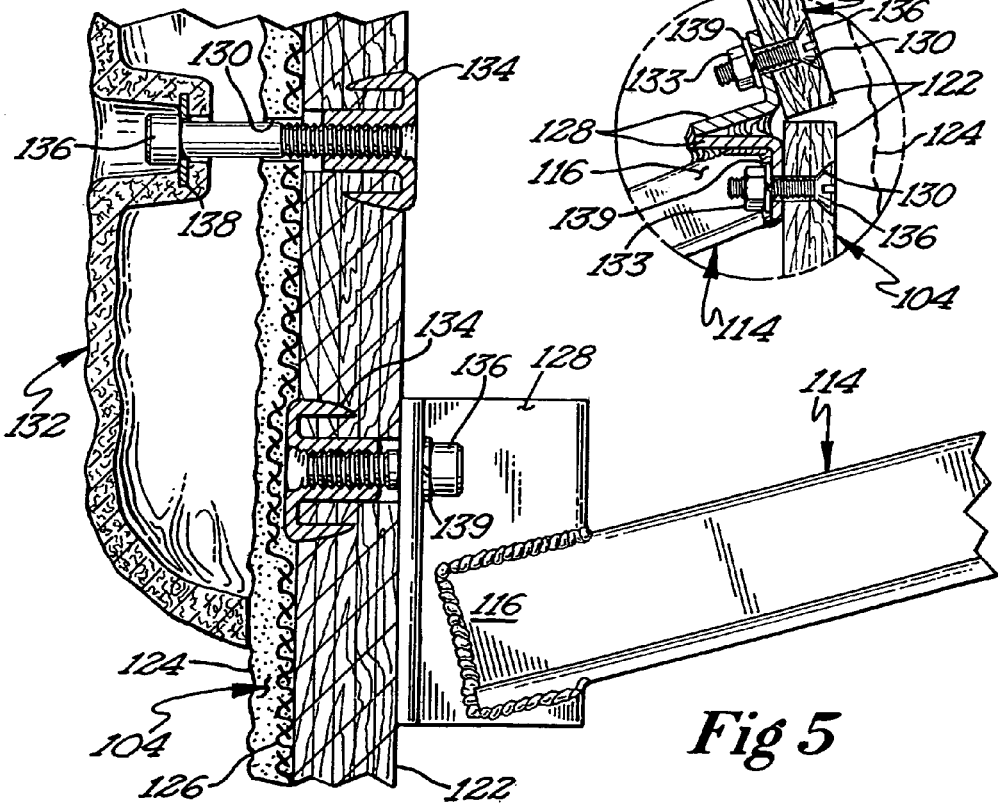
FIG. 5 is an enlarged sectional view of wall panel mounting in the present invention.

FIG. 5 is an enlarged sectional view of wall panel mounting in the present invention. Kicker struts 114 are mounted to angle irons 128. The angle irons 128 are mounted to the wall panel 104. It will be appreciated by those skilled in the art that the kicker struts 114 and the angle irons 128 may be mounted via a t-nut 134 and bolt 136 system. Furthermore, handhold devices 132 may be mounted to the wall panel 104 to aid in a climber's ascent of the wall structure 100. In preferred embodiments the wall panels 104 have several apertures 130 formed therethrough. The handhold devices 132 may be mounted onto the wall panel apertures 130 via t-nut 134 and bolt 136 systems. In addition, a washer 138 may be included in the handhold device 132 installation to prevent cracking and splitting. As shown in FIG. 1, the bolt 136 could be replaced by a screw in combination with a locking washer 139 and nut 133. It will be understood by those skilled in the art that the handhold device 132 may be selectively mounted to the apertures 130 to form reconfigurable routes on the wall panels 104. Additionally, it will be recognized that the handhold devices 132 can not only be applied to the wall panels 104 in a varying number and at points to be selected at will, but they can also be disposed at each positioning point with the orientation which is judged the most suitable. For example, a handhold device 132 could be applied and rotated on a wall panel 132 at 90 degrees. The same handhold device 132 could also be rotated 45, 60, 180, etc. degrees at the same or different location on the wall panel 104. It will be understood by those skilled in the art that reconfigurable routes add variety and challenge to the rock climbing sport.

Figure 5A:
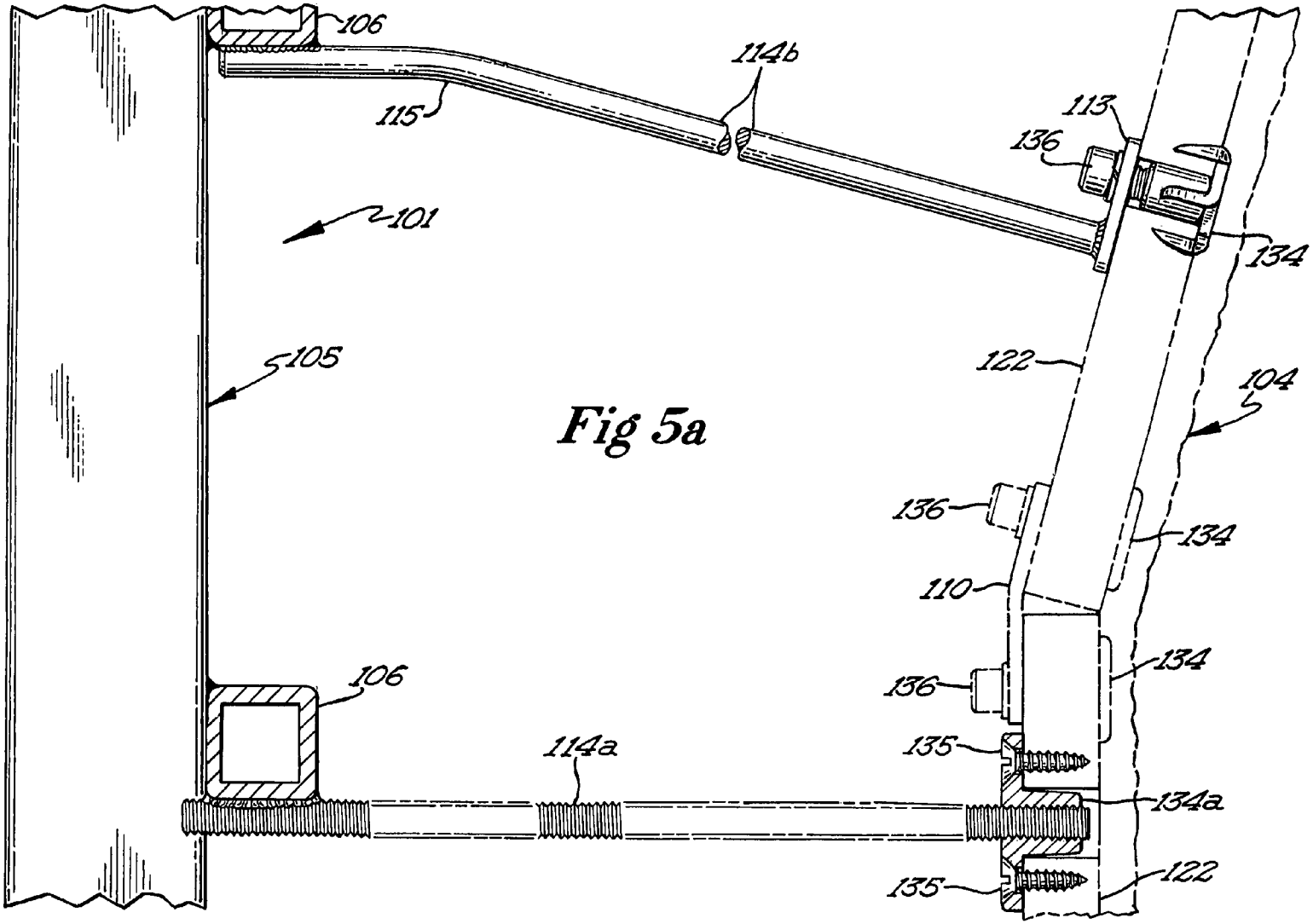
FIG. 5*a* is an enlarged sectional view of wall panel mounting with alternative rods and threaded rods used in place of kicker struts.

In alternative embodiments, as shown in FIG. 5*a*, the kicker struts 114 could be replaced with rods 114*b* with an flat iron 113 welded on one end and attached to the wall panel 104 via a t-nut 134 and bolt 136 system. Alternatively, a screw in pallet nut 134*a* that is attached to the wall panel 104 with screws 135 could replace any t-nut 134. In addition, a threaded rod 114*a* could replace any kicker strut 114 and be threaded directly into a pallet nut 134*a* to also replace a bolt 136. One advantage of using rods 114*a* or 114*b* is that they could have a bend point 115 added to them to accommodate various angles needed to attach the rods to girders 106.

In preferred embodiments as shown in FIG. 5, the wall panel 104 is constructed from plywood 122 and has a metal mesh 126 and texture overlay 124. It will be appreciated by those skilled in the art that the wall panel 104 may have a concrete or other polymer texture overlay (e.g. acrylics, epoxies, urethanes, or polyurethanes). Also, the metal mesh 126 may be exterior to the texture overlay 124 or may be between the texture-overlay 124 and plywood 122. It will be appreciated by those skilled in the art that the metal mesh 126 is an optional addition to the wall panels 104. In an alternative embodiment, an adhesive compatible with the liquid concrete texture is used in place of the metal mesh 126 to bond the concrete texture 124 to the plywood 122.

Figure 6:
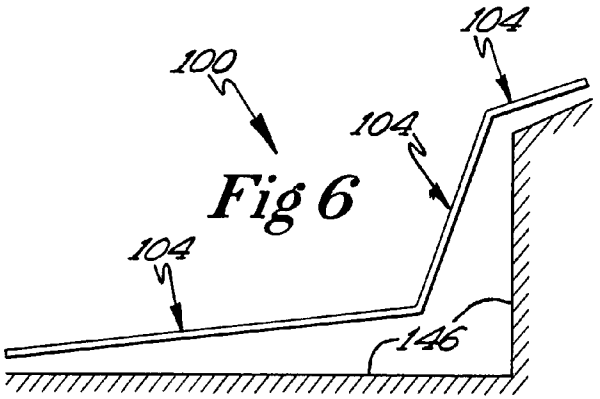
FIG. 6 is a top plan diagram of a wall structure as related to an adjacent building wall.
Figure 8:
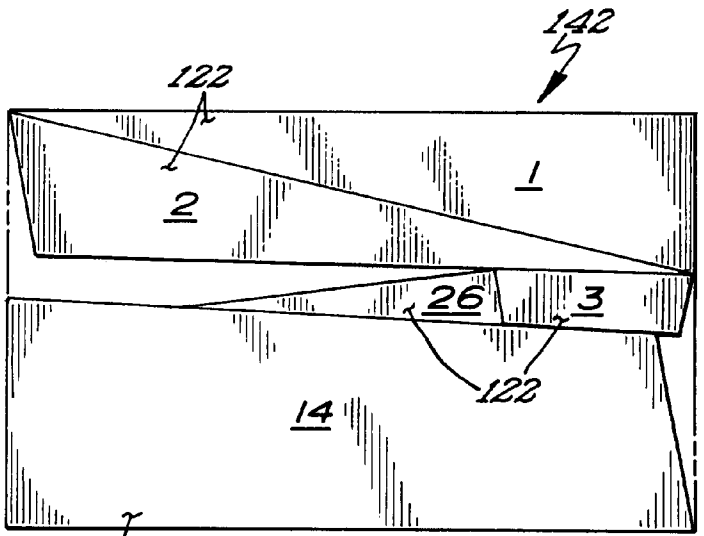
FIG. 8 is a perspective view of a plywood sheet of standard size with various wall panels laid out on the plywood sheet.
Figure 7:
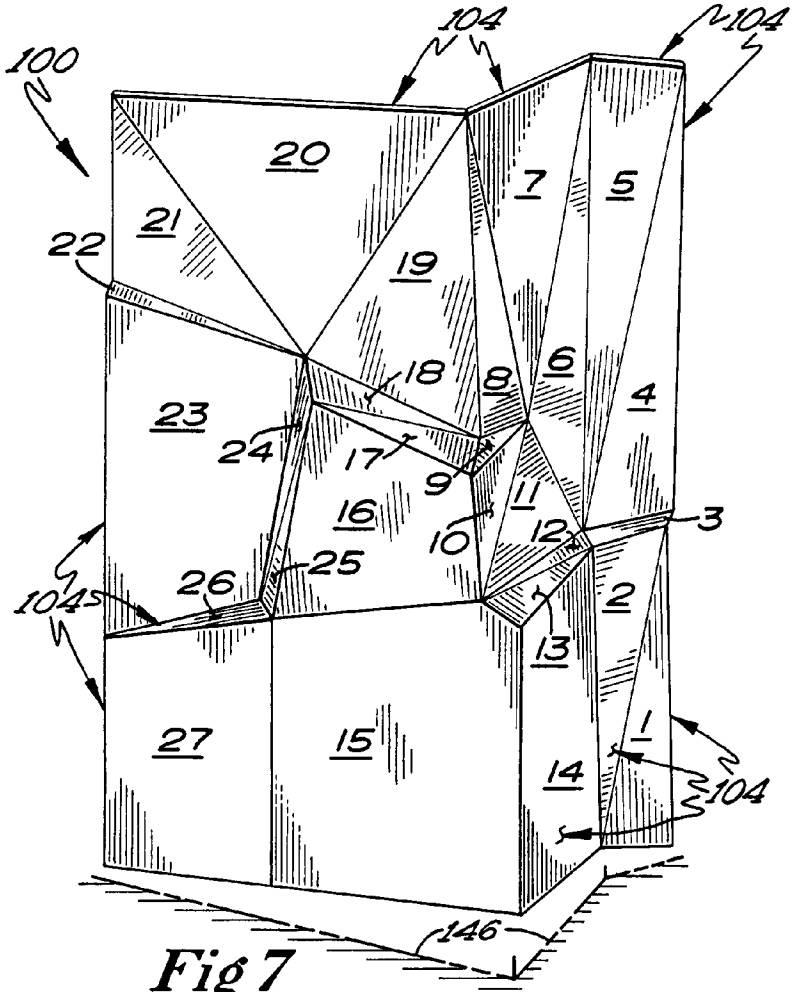
FIG. 7 is a computer generated perspective view of wall panels in place for typical wall structure installation.

FIG. 6 is a top plan diagram of a wall structure 100 as related to an adjacent building wall 146. Furthermore, FIG. 7 is a computer generated perspective view of wall panels 104 in place for typical wall structure 100 installation. FIG. 8 is a perspective view of a sheet of plywood of standard size with various wall panels 104 laid out on the plywood sheet. This prearranged sketch 142 helps reduce material costs, provides efficiency in arranging the wall panels 104, and reduces waste. The manufacturing costs of the wall panels 104 can be contained within limits due to the smaller amount of raw materials required. Therefore the overall costs for arrangement of the wall structure 100 can also be reduced. Also, the possibilities of partly varying the wall panels 104 in accordance with the invention or fully dismantling and recombining them in different configurations should be considered.

In preferred embodiments, first the primary frame 106 is installed to an adjacent building wall 146. Next, wall panels 104 are cut from a prearranged sketch 142. Web straps 140 are mounted to the primary frame 106 and then removably connected to the wall panels 104. The web straps 140 position the wall panels 104 in a desired configuration planned from the computer generated perspective view. Thereafter, kicker struts 114 are typically fixed to the primary frame 106 and wall panels 104. In particular, the first ends 116 of the kicker struts 114 are attached to a center region of the wall panels 104. The second ends 118 of the kicker struts 114 are attached to the primary frame 106. Angle irons 128 or threaded rod 114*a* are typically used to connect the kicker struts 114 to the wall panels 104. Mounting brackets 110 are secured between wall panels 104 to help form an integral exterior surface 112. Subsequently, the web straps 140 are removed from the primary frame 106 and wall panels 104.

It is to be understood that even though numerous characteristics and advantages of various embodiments of the present invention have been set forth in the foregoing description, together with details of the structure and function of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. For example, the plywood could be replaced by thinner plywood, oriented strand board, medium density fiber board, high density fiber board, sheetrock, sheet metal, concrete board, fiber glass panels and the like without departing from the scope and spirit of the present invention.

What is claimed is:

1. An artificial climbing wall structure comprising:

a primary frame;

a plurality of planar wall panels, each wall panel having a periphery adapted for abutment with an adjacent wall panel, each wall panel connected to adjacent wall panels via a mounting bracket, whereby the wall panels form an integral collection of exterior surfaces of varying angles between planes of the wall panels that are adapted for climbing; and kicker struts, each kicker strut having opposite first and second ends; the first end comprising a flat bearing surface which is mounted on the wall panel, and the second end having a second flat bearing surface which is secured to the primary frame.

2. The artificial climbing wall structure of claim 1 wherein the wall panels are comprised of plywood and texture overlay.

3. The artificial climbing wall structure of claim 2 wherein the texture overlay is exterior to the plywood.

4. The artificial climbing wall structure of claim 2 wherein a metal mesh is located between the texture overlay and the plywood.

5. The artificial climbing wall structure of claim 1 wherein the wall panels are comprised of plywood and polymer overlay.

6. The artificial climbing wall structure of claim 2 wherein the wall panels have an irregular shape to resemble a natural rock surface.

7. The artificial climbing wall structure of claim 1 wherein the kicker struts are mounted to angle irons which are mounted at flat non-peripheral regions of the wall panels.

8. The artificial climbing wall structure of claim 1 wherein the kicker struts are formed from threaded rod and mounted to the apertures via t-nuts or pallet nuts.

9. The artificial climbing wall structure of claim 1 wherein at least one wall panel has an aperture to mount handholds.

10. The artificial climbing wall structure of claim 9 wherein the handholds are mounted to the apertures via t-nuts or pallet nuts and bolts.

11. The artificial climbing wall structure of claim 9 wherein the handholds are selectively mounted to the apertures to form reconfigurable climbing routes on the wall panels.

12. The artificial climbing wall structure of claim 1 wherein the wall panels are adaptable for gripping by a climber.

13. The artificial climbing wall structure of claim 1 wherein the kicker struts are secured to mounting brackets on the primary frame.

14. The artificial climbing wall structure of claim 1 wherein the wall panels are cut from a prearranged sketch thereby utilizing less substrate material.

15. The artificial climbing wall structure of claim 1 wherein the kicker struts are secured to the wall panel and primary frame via a fastener selected from the group consisting of: bolts, screws, pop rivets, glue, and nails.

16. The artificial climbing wall structure of claim 1 wherein webbing is removably connected between the primary frame and wall panels for positioning the wall panels in a desired configuration.

17. An artificial climbing wall structure having an exterior surface adapted for climbing, comprising a primary frame to which a plurality of wall panels, each wall panel having a flat interior surface, is attached by a plurality of kicker struts; immediately adjacent wall panels abutting each other at angles that give the exterior surface a non-curved profile; in which each kicker strut has a flat end attached to a non-peripheral location of the flat interior surface of a wall panel, and an opposite end secured to the primary frame.

18. An artificial climbing wall structure having a multi-faceted exterior surface adapted for climbing, comprising a primary frame to which a plurality of wall panels, each wall panel having a flat interior surface and peripheral edges, is attached by a plurality of kicker struts; immediately adjacent wall panels arranged with each other to form planar angles between their abutting peripheral edges; in which each kicker strut has a flat end attached to a central region of the flat interior surface of a wall panel, and an opposite end secured to the primary frame.

* * * * *